US012588750B2

(12) United States Patent
Quan

(10) Patent No.: US 12,588,750 B2
(45) Date of Patent: Mar. 31, 2026

(54) BRISTLE PRESERVING PAINTBRUSH COVER

(71) Applicant: Jason Christopher Quan, Phoenix, AZ (US)

(72) Inventor: Jason Christopher Quan, Phoenix, AZ (US)

( * ) Notice: Subject to any disclaimer, the term of this patent is extended or adjusted under 35 U.S.C. 154(b) by 0 days.

(21) Appl. No.: 18/677,861

(22) Filed: May 29, 2024

(65) Prior Publication Data

US 2025/0366604 A1 Dec. 4, 2025

(51) Int. Cl.
*A46B 17/04* (2006.01)

(52) U.S. Cl.
CPC ..... *A46B 17/04* (2013.01)

(58) Field of Classification Search
CPC ..... A46B 17/04
See application file for complete search history.

(56) References Cited

U.S. PATENT DOCUMENTS 1,612,867 A * 1/1927 Hedenskoog ..... A63D 5/08 473/84
4,423,811 A * 1/1984 Knapp ..... B65D 43/162 220/4.23
4,847,939 A * 7/1989 Derencsenyi ..... B44D 3/125 16/110.1
5,084,932 A * 2/1992 Zanchi ..... A46B 11/0093 15/168
5,244,090 A * 9/1993 Keith ..... A46B 17/04 220/699
5,465,453 A 11/1995 Landmeier
6,199,694 B1 3/2001 Van Diest
6,338,406 B1 * 1/2002 Zagar ..... A46B 17/04 206/362.2
6,390,430 B1 * 5/2002 Hawley ..... B44D 3/12 206/362.4
6,698,336 B1 * 3/2004 Siegel ..... A21B 3/138 99/428
8,668,085 B1 * 3/2014 Oliver ..... A46B 17/04 15/247
11,690,443 B1 7/2023 Couch
2001/0047948 A1 12/2001 Cummings
2004/0050732 A1 * 3/2004 Baker ..... A46B 17/04 206/15.2
2015/0230597 A1 * 8/2015 Gabbard ..... A46B 17/04 15/247
2022/0031059 A1 2/2022 Lamont
2023/0270245 A1 8/2023 Jordain

* cited by examiner

*Primary Examiner* — James N Smalley
(74) *Attorney, Agent, or Firm* — Legacy Patents, LLC; Lauren Edwards Williams

(57) ABSTRACT

A paintbrush cover is constructed of an elastic material and has a deformable inlet and outlet that a paintbrush can be inserted and withdrawn from respectively. The paintbrush may be withdrawn in the same direction that it was inserted, such that the bristles are never forced to bend against the cover. In use, the handle is inserted into the inlet, pushed through the interior cavity, and pulled through the outlet, until the bristles and ferrule of the brush are entirely enclosed by the cover. The portion of the cover body nearest the inlet is inwardly tapered towards the front such that the brush bristles are maintained parallel to each other, and come to a fine edge, maintaining the proper arrangement of the bristles for the next time it is used.

14 Claims, 4 Drawing Sheets

BRISTLE PRESERVING PAINTBRUSH COVER

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of painting accessories of existing art and more specifically relates to a paintbrush cover.

RELATED ART

Paintbrushes are tools used to apply paint to surfaces. Conventional paintbrushes are characterized by a handle, bristles for applying the paint, and a ferrule to bind the bristles to the handle. For effective painting, the ferrule must hold the bristles in alignment with each other, and the bristles must be aligned in a controlled edge to engage the surface to be painted in a predictable fashion. In theory, paintbrushes are resilient devices able to be cleaned and reused repeatedly.

However, in practice, paintbrushes usually do not see their full potential service life. There are several reasons for this. Firstly, if not cleaned and stored properly, paint will dry on the bristles, hardening them, binding them together, and making the paintbrush unusable. Secondly, the paintbrushes may be stored improperly, and may be damaged in a drawer, etc., such that the bristles are misaligned and deteriorated, and such that they no longer paint well. Thirdly, if cleaning is attempted, they may become saturated with water and insufficiency dried, such that they water down new paint applied to the brush, and are therefore not immediately reusable.

A common solution is to wrap a paintbrush in plastic wrap or another material after painting. This prevents the paint from immediately drying out, such that a user does not need to clean the paintbrush constantly for brief breaks in painting. However, such a solution does nothing to protect the bristles, and if the paintbrush must be dried, prohibits drainage of the brush. If the paintbrush is cleaned, then painters often lack a solution altogether to dry and store the paintbrush safely. If the paintbrush is stood up against a surface to drain, then this applies pressure to the bristle ends and can permanently damage the paintbrush. A suitable solution is desired.

U.S. Pat. No. 6,932,217 to David Bailey relates to a paint brush cover. The described paint brush cover includes a paint brush cover which will protect the bristles of a paint brush after it has been used. The cover is formed from a planar sheet of liquid-resistant material and is provided with fold lines about which the sheet may be folded around and releasably secured to at least the bristle portion of the brush. However, Bailey's patent does not provide sufficient structural support to protect the bristles, and is not suited to drainage or repeated use due to the construction of the cover, even if made of liquid-resistant materials. A superior solution is desired.

SUMMARY OF THE INVENTION

In view of the foregoing disadvantages inherent in the known paintbrush accessory art, the present disclosure provides a novel bristle preserving paintbrush cover. The general purpose of the present disclosure, which will be described subsequently in greater detail, is to provide an effective bristle preserving paintbrush cover.

A paintbrush cover is constructed of an elastic material and has a deformable inlet and outlet that a paintbrush can be inserted and withdrawn from repeatedly. The cover may protect the bristles from accidental deformation and may also prevent the brush from drying out across a short duration of time. The paintbrush may be withdrawn in the same direction that it was inserted, such that the bristles are never forced to bend against the inside of the cover. In use, the handle is inserted into the inlet, pushed through the interior cavity, and pulled through the outlet, until the bristles and ferrule of the brush are entirely enclosed by the cover. The portion of the cover body nearest the inlet is inwardly tapered towards the front such that the brush bristles are maintained parallel to each other, and come to a fine edge, maintaining the proper arrangement of the bristles for the next time it is used. When the paintbrush is to be used, it may be withdrawn from the cover by continuing to pull the handle out from the outlet. Here, the cover body is constricted around the base of the handle, and it must deform to enable the main body and ferrule of the brush to pass through. Additionally, projections on the interior of the cover body further resist movement of the brush, preventing accidental withdrawal of the brush from the cover. Throughout the entirety of this withdrawal motion, the bristles are always pulled, not pushed, and they remain straight and aligned. Once the paintbrush is in the cover, the cover protects the bristles. Additionally, if the brush needs to dry, the cover can be propped up with the inlet/bristle end down, allowing the paintbrush to drain without applying any damaging pressure to the bristles.

For the purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a bristle preserving paintbrush cover, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a painting accessory and more particularly to a bristle preserving paintbrush cover as used to improve the longevity and alignment of paintbrush bristles between uses.

Referring now more specifically to the drawings by numerals of reference, there is shown in FIGS. 1-4, various views of a paintbrush cover 100.

Figure 1:
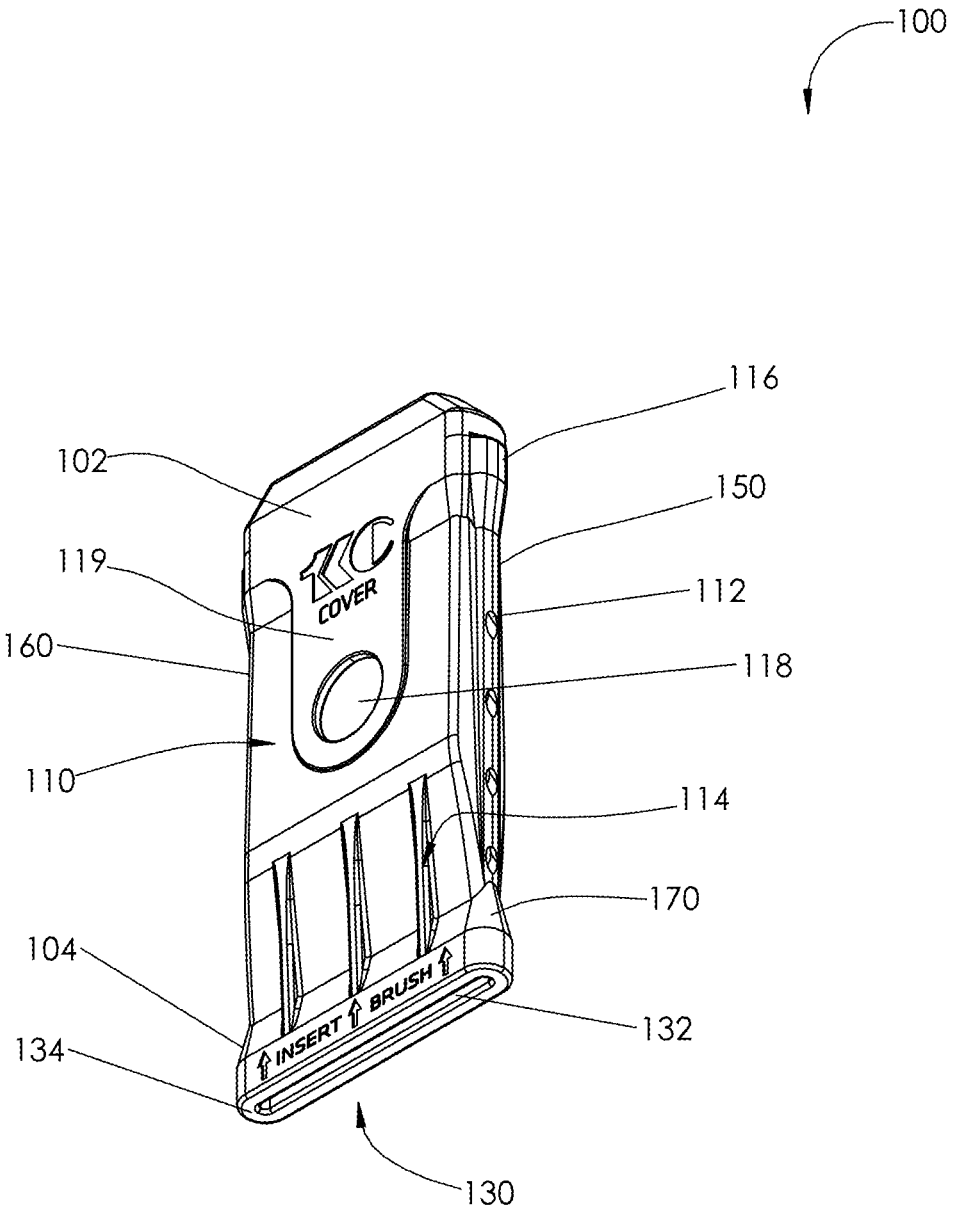
FIG. 1 is a perspective view of the paintbrush cover according to an embodiment of the disclosure.

FIG. 1 shows a paintbrush cover according to an embodiment of the present disclosure. Here, the paintbrush cover may be beneficial for use by a user to protect the bristles of a brush when not in active use. As illustrated, the paintbrush cover may include a single unitary body 100. Unitary body 100 may be injection molded, 3D printed, or formed by other industrial manufacturing processes. Unitary body 100 is configured to enclose and protect a paintbrush. An example paintbrush for use with the paintbrush cover may include at least a handle, bristles, and a ferrule bounding the bristles and connecting them to the handle. However, it is envisioned that other types of paintbrushes (such as foam brushes) may also be used with the cover in some embodiments.

Unitary body 100 may enclose an interior space (or interior cavity) 200 perforated by inlet 132 (associated with a first end 130) and outlet 142 (associated with a second end 140). Interior space 200 is structured and arranged to cover, surround, and contain a paintbrush, fully enclosing the bristles, but permitting the handle to extend out one end. Unitary body 100 (and accordingly interior space 200) is inwardly tapered towards inlet 132, narrowing towards the end in order to keep the bristles of the paintbrush aligned toward a straight edge proximal to inlet 132.

Unitary body 100 may include front sidewall 110, rear sidewall 120, right edge 150, and left edge 160, which forms interior space 200 to be roughly rectangular at a cross section, corresponding to the roughly rectangular shape of a paintbrush ferrule. Front sidewall 110 and rear sidewall 120 each inwardly taper towards inlet 132, closing to one-quarter of an inch or less in some embodiments. It should be understood that the breadth of this taper may be adjusted in covers for variously sized paintbrushes, and that this gap expands in size when a paintbrush is initially inserted, as the handle and ferrule of the paintbrush must pass through this part of the cover before the bristles come to rest within it. Such expansion is enabled by the elasticity and expandability of the material which unitary body 100 is constructed of.

In a preferred embodiment, front sidewall 110 may be perforated by an aperture (or viewing port) 118, aperture 118 being at least one quarter of an inch in diameter in a preferred embodiment. Viewing port may enable a user to see part of the bristles of the brush while it is enclosed in unitary body 100.

Each of right edge 150 and left edge 160 may be perforated by at least one vent 112. Vents 112 permit air passage through unitary body 100 even when the paintbrush is installed, and prevents suction within unitary body 100 from preventing withdrawal of the paintbrush. Additionally, vents 112 may enact drainage of the paintbrush if the bristles are wet. In an ideal embodiment, four circular vents 112 on each side (right edge 150 and left edge 160) may be used. However, in various embodiments, alternative quantities and shapes of vents 112 may be implemented. Some embodiments may also include vents on the front sidewall 110 and rear sidewall 120, Each of front sidewall 110 and rear sidewall 120 may have at least one strengthening rib (or ridge) 114 running parallel to an axis formed from inlet 132 to outlet 142. In the illustrated embodiment, three ribs 114 are provided on each side, running in the same direction that the paintbrush is inserted and withdrawal. These ribs 114 may add rigidity to the cover, such that the cover does not bend and thereby deform the bristles of the brush when the paintbrush is inserted or withdrawn. As shown, these strengthening ribs 114 are located on the exterior of the unitary body 100, integrated with each of front sidewall 110 and rear sidewall 120.

Front sidewall 110 may also include an apron 119 circumscribing aperture 118. Apron 119 may simply be a flat section where the thickness of front sidewall 110 is increased to strengthen the rigidity of the cover around aperture 118. Various structural and ornamental designs may be implemented. Furthermore, a strengthening apron 119 may be utilized even if aperture 118 is not.

Unitary body 100 should be constructed of a strong but flexible material such as silicone, rubber, or TPU, being sufficiently elastic such that a paintbrush having a handle, bristles, and a ferrule may be inserted handle first into inlet 132, such that the bristles and the ferrule are contained within interior space 200, and the handle projects outwardly from outlet 142, and such that the brush may be withdrawn out of outlet 142. Alternative materials may include polyvinyl chloride, nitrile butadiene rubber, neoprene, or other materials with sufficient elasticity and durability.

Preferably, inlet 132 is no more than ten percent narrower than the distance between right edge 150 and left edge 160. Inlet 132 may extend between right edge 150 and left edge 160. Unitary body 100 may also include skirt 134 circumscribing and adding rigidity to inlet 132. The rigidity of this part of the cover is important to maintain orientation and alignment of the paintbrush bristles. Skirt 134 may be chamfered around inlet 132 to ease insertion of a handle of a paintbrush into inlet 132.

Figure 2:
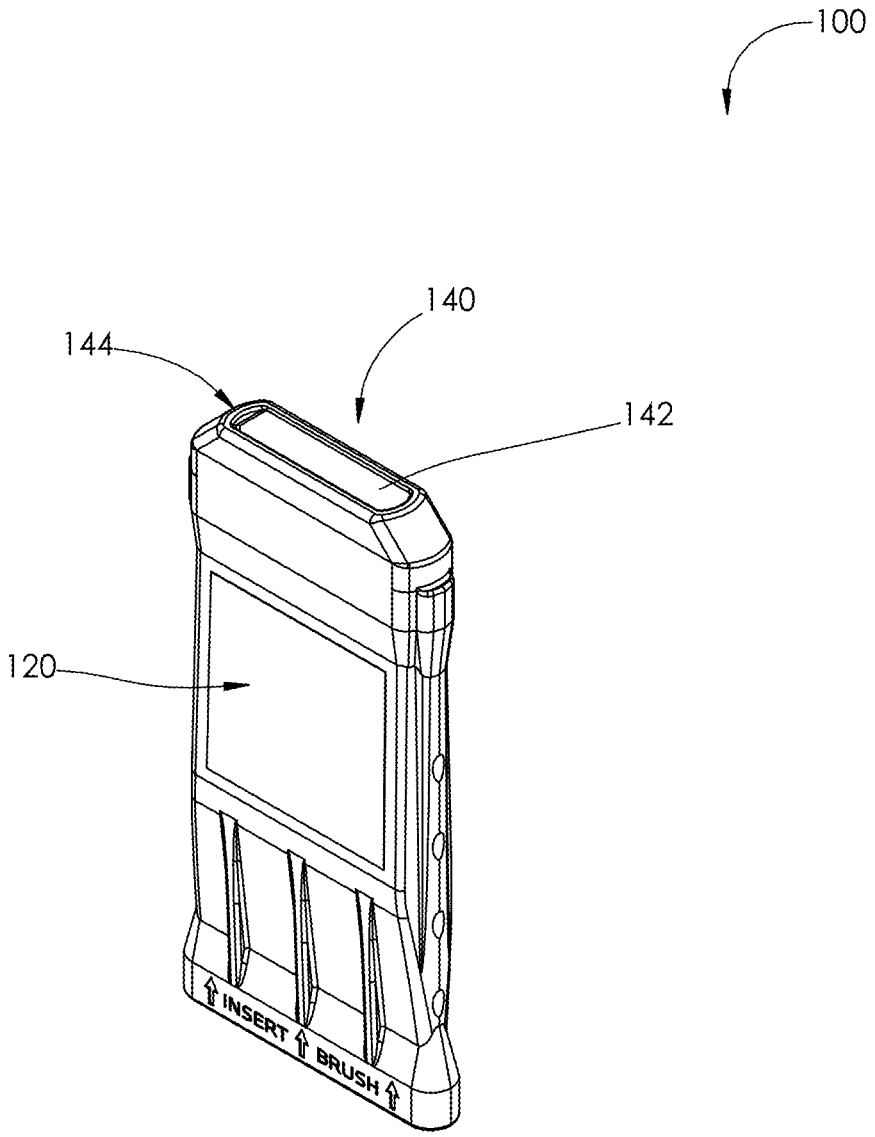
FIG. 2 is a perspective view of an outlet end of the paintbrush cover of FIG. 1, according to an embodiment of the present disclosure.

FIG. 2 shows the rear sidewall 120 paintbrush cover of FIG. 1, according to an embodiment of the present disclosure. In the illustrated embodiment, rear sidewall 120 includes no perforations, although this may vary in alternative embodiments. As above, the paintbrush cover 100 may include an outlet 142 perforating 140, through which a paintbrush may be withdrawn. As shown, outlet 142 is constructed from the broadest cross section of the interior space 200, being bounded and strengthened by lip 144. Lip 144 may be exterior chamfered so that unitary body 100 is less likely to snag in a work environment. Lip 144 must stretch around the paintbrush when force is applied to the handle by a user to withdraw the paintbrush from the paintbrush cover. The more thick or stiff that lip 144 is, the more difficult it will be to withdraw the paintbrush out of the interior space 200. It should be understood that the exact shape and thickness of lip 144 may vary to provide optimal retention for variously sized paintbrushes. As shown, outlet 142 may narrower than the distance between right edge 150 and left edge 160.

Figure 3:
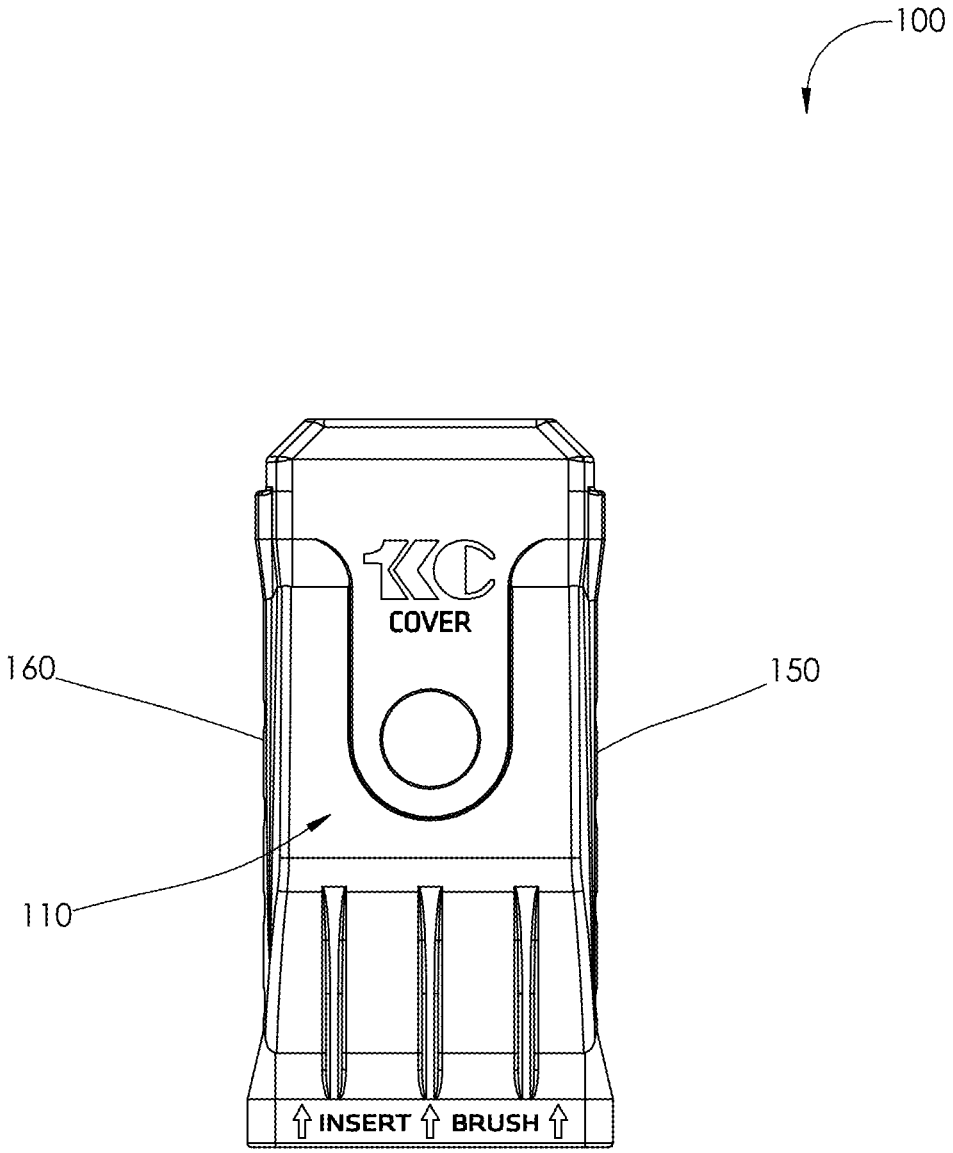
FIG. 3 is a perspective view of a front sidewall of the paintbrush cover of FIG. 1, according to an embodiment of the present disclosure.

FIG. 3 is a perspective view of the front of the paintbrush cover of FIG. 1, according to an embodiment of the present disclosure. As shown, right edge 150 and left edge 160 are substantially parallel to each other in the illustrated embodiment, and bound the interior space 200 (FIG. 4), and are bridged by front sidewall 110 and rear sidewall 120 (FIG. 2).

Figure 4:
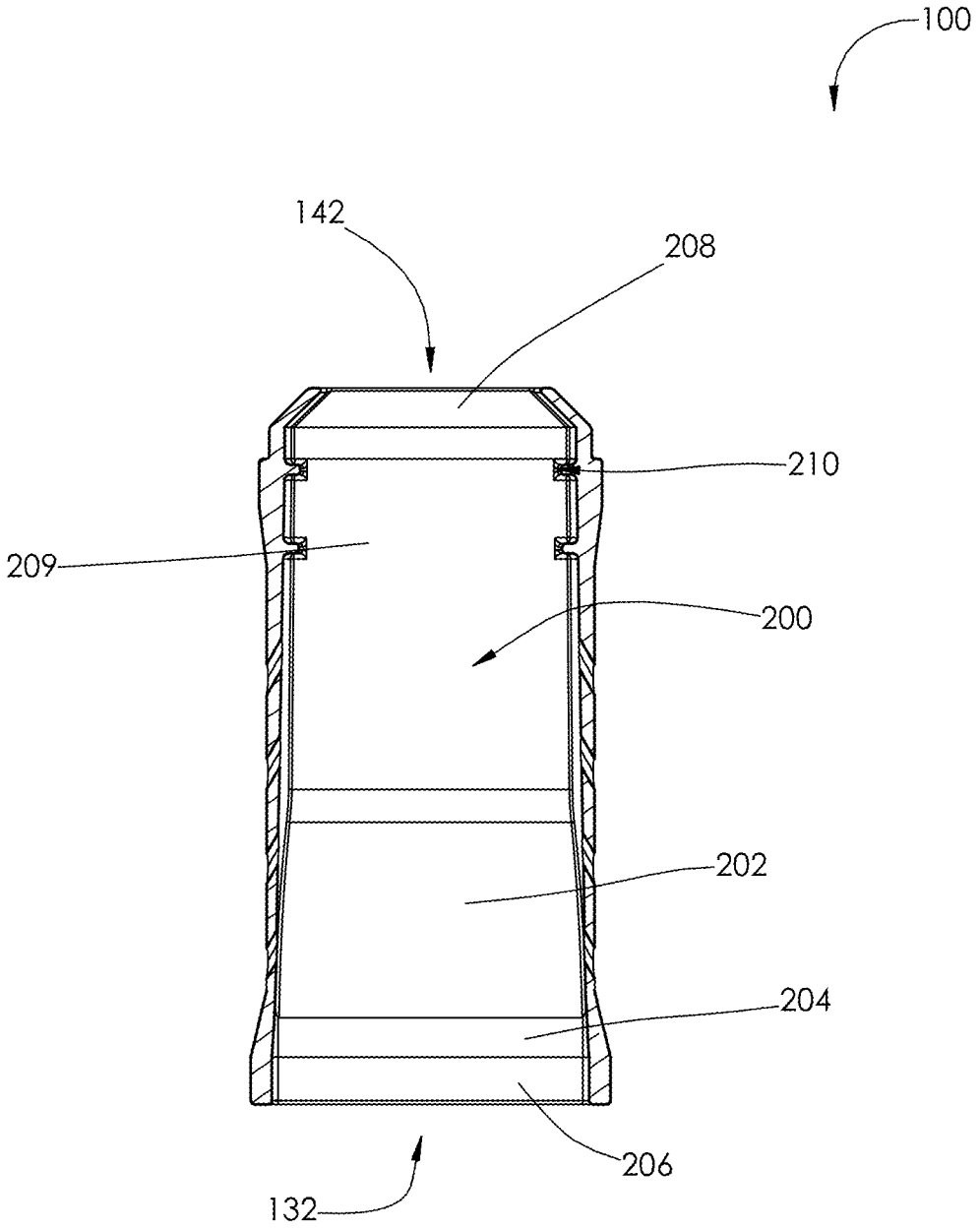
FIG. 4 is a perspective view of a cutaway of the paintbrush cover of FIG. 1 illustrating the interior cavity, according to an embodiment of the present disclosure.

FIG. 4 is a perspective view of a cutaway of the paintbrush cover of FIG. 1 illustrating the interior cavity, according to an embodiment of the present disclosure. As shown, unitary body 100 may include at least two projections 210 advancing inwardly into interior space 200, such that when the paintbrush is inserted into interior space 200, the projections 210 press against the paintbrush and resist withdrawal of the paintbrush from interior space 200. Each of at least two projections 210 may bridge front sidewall 110 to rear sidewall 120. Preferably, each of these projections 210 are small, straight, rounded nubs built into the inside of right edge 150 and left edge 160, with a small breadth (for example, an eight of an inch). It should be understood that the shape and size of projections 210 may vary with covers for variously sized paintbrushes. In some embodiments, anywhere from two to ten or more projections may be included, although four is seen as ideal.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A paintbrush cover comprising:

a unitary body enclosing an interior space perforated by an inlet and an outlet, the unitary body including:

at least two projections advancing inwardly into the interior space, such that when a paintbrush is inserted into the interior space, the at least two projections press against the paintbrush and resist withdrawal of the paintbrush from the interior space;

wherein the unitary body is inwardly tapered towards the inlet;

wherein the unitary body is sufficiently elastic such that a paintbrush having a handle, bristles, and a ferrule may be inserted handle first into the inlet, such that the bristles and the ferrule are contained within the interior space, and the handle projects outwardly from the outlet, and such that the brush may be withdrawn out of the outlet; and wherein the unitary body further comprises a right edge and a left edge, and wherein at least one of the right edge and the left edge are perforated by at least one vent.

2. The paintbrush of claim 1, wherein the unitary body further comprises a front sidewall, and a rear sidewall, wherein the front side, the rear sidewall, the right edge and the left edge form a substantially rectangular structure enclosing the interior space.

3. The paintbrush cover of claim 2, wherein the front sidewall and the rear sidewall each inwardly taper towards the inlet.

4. The paintbrush cover of claim 2, wherein the front sidewall is perforated by an aperture, the aperture being at least one quarter of an inch in diameter.

5. The paintbrush cover of claim 2, wherein each of the front sidewall and the rear sidewall comprise at least one strengthening rib running parallel to an axis formed from the inlet to the outlet, and wherein the at least one strengthening rib is exterior to the interior space.

6. The paintbrush cover of claim 2, wherein each of the at least two projections bridge the front sidewall to the rear sidewall.

7. The paintbrush cover of claim 4, wherein the front sidewall further comprises an apron circumscribing the aperture.

8. The paintbrush cover of claim 1, wherein the outlet is narrower than the distance between the right edge and the left edge.

9. The paintbrush cover of claim 1, wherein the inlet is no more than ten percent narrower than the distance between the right edge and the left edge.

10. The paintbrush cover of claim 1, wherein the inlet extends between the right edge and the left edge.

11. The paintbrush cover of claim 1, wherein the unitary body further comprises a skirt circumscribing and adding rigidity to the inlet.

12. The paintbrush cover of claim 11, wherein the skirt is chamfered around the inlet to ease insertion of a handle of a paintbrush into the inlet.

13. A paintbrush cover comprising:

a unitary body enclosing an interior space perforated by an inlet and an outlet, the unitary body including a front sidewall, a rear sidewall, a right edge, and a left edge, wherein the front sidewall, the rear sidewall, the right edge, and the left edge form a substantially rectangular structure enclosing the interior space;

at least two projections advancing inwardly into the interior space, such that when a paintbrush is inserted into the interior space, the projections press against the paintbrush and resist withdrawal of the paintbrush from the interior space;

wherein the unitary body is inwardly tapered towards the inlet;

wherein the front sidewall and the rear sidewall each inwardly taper towards the inlet;

wherein the front sidewall is perforated by an aperture, the aperture being at least one quarter of an inch in diameter;

wherein each of the right edge and the left edge are perforated by at least one vent;

wherein each of the at least two projections bridge the front sidewall to the rear sidewall;

wherein the unitary body is sufficiently elastic such that a paintbrush having a handle, bristles, and a ferrule may be inserted handle first into the inlet, such that the bristles and the ferrule are contained within the interior space, and the handle projects outwardly from the outlet, and such that the brush may be withdrawn out of the outlet;

wherein the outlet is narrower than the distance between the right edge and the left edge; and wherein the inlet extends between the right edge and the left edge.

14. A paintbrush cover comprising:

a unitary body enclosing an interior space perforated by an inlet and an outlet, the unitary body including:

at least two projections advancing inwardly into the interior space, such that when a paintbrush is inserted into the interior space, the at least two projections press against the paintbrush and resist withdrawal of the paintbrush from the interior space;

wherein the unitary body is inwardly tapered towards the inlet;

wherein the unitary body is sufficiently elastic such that a paintbrush having a handle, bristles, and a ferrule may be inserted handle first into the inlet, such that the bristles and the ferrule are contained within the interior space, and the handle projects outwardly from the outlet, and such that the brush may be withdrawn out of the outlet; and wherein the unitary body further comprises a front sidewall, and wherein the front sidewall is perforated by an aperture.

* * * * *